US010781819B2

(12) United States Patent
Watanabe et al.

(10) Patent No.: US 10,781,819 B2
(45) Date of Patent: Sep. 22, 2020

(54) FAN DEVICE WITH IMPELLER HAVING CIRCULAR PLATE OPENING, SIDEWALL OPENING AND GROOVE CONNECTING THE CIRCULAR PLATE OPENING WITH THE SIDEWALL OPENING FOR EFFICIENTLY COOLING MOTOR

(71) Applicant: SANYO DENKI CO., LTD., Tokyo (JP)

(72) Inventors: Jiro Watanabe, Tokyo (JP); Masashi Miyazawa, Tokyo (JP); Akira Nakayama, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 421 days.

(21) Appl. No.: 15/083,624

(22) Filed: Mar. 29, 2016

(65) Prior Publication Data

US 2016/0290346 A1 Oct. 6, 2016

(30) Foreign Application Priority Data

Mar. 31, 2015 (JP) ..... 2015-073858

(51) Int. Cl.
*F04D 19/00* (2006.01)
*F04D 25/06* (2006.01)
(Continued)

(52) U.S. Cl.
CPC ..... *F04D 19/002* (2013.01); *F04D 25/064* (2013.01); *F04D 29/329* (2013.01); *F04D 29/5806* (2013.01)

(58) Field of Classification Search
USPC ..... 417/366, 368; 310/62
See application file for complete search history.

(56) References Cited

U.S. PATENT DOCUMENTS 3,303,995 A 2/1967 Boeckel
3,385,516 A * 5/1968 Omohundro ..... F04D 25/082 416/186 R (Continued)

FOREIGN PATENT DOCUMENTS

| | | |
|---|---|---|
| JP | 10-210727 | 8/1998 |
| JP | 2008-17607 | 1/2008 |
| JP | 2008-121440 | 5/2008 |

OTHER PUBLICATIONS

Philippine Office Action dated Nov. 5, 2018 for the corresponding Philippine Patent Application No. 1-2016-000123.

(Continued)

*Primary Examiner* — Peter J Berthheaud
*Assistant Examiner* — Geoffrey S Lee
(74) *Attorney, Agent, or Firm* — Rankin, Hill & Clark LLP

(57) ABSTRACT

An impeller includes: a cylinder that includes a circular plate-shaped circular plate and a peripheral wall that extends from an outer peripheral edge of the circular plate along a rotation shaft of the impeller; and a blade mounted to an outer peripheral surface of the peripheral wall, the blade being configured to send air. The circular plate has a circular plate opening at a center, the circular plate opening penetrating the circular plate along the rotation shaft, and a sidewall opening is formed at the peripheral wall, the sidewall opening penetrating the peripheral wall along a direction different from a direction parallel to the rotation shaft.

5 Claims, 8 Drawing Sheets

(51) Int. Cl.
*F04D 29/58* (2006.01)
*F04D 29/32* (2006.01)

(56) References Cited

U.S. PATENT DOCUMENTS 3,449,605 A * 6/1969 Wilson ..... B01D 46/0021 310/58
3,993,415 A * 11/1976 Hauser ..... F01P 7/042 416/93 R
4,150,919 A * 4/1979 Matucheski ..... F04D 29/329 416/169 A
4,583,911 A * 4/1986 Braun ..... F04D 29/681 415/116
5,236,306 A * 8/1993 Hozak ..... B60H 1/00464 310/62
6,379,116 B1 * 4/2002 Tai ..... F04D 25/0613 416/210 R
6,384,494 B1 * 5/2002 Avidano ..... H02K 9/06 310/58
6,773,239 B2 * 8/2004 Huang ..... F04D 25/082 310/62
7,061,155 B1 * 6/2006 Lee ..... H02K 5/10 310/261.1
7,122,924 B2 * 10/2006 Lee ..... H02K 9/06 310/62
7,227,286 B2 6/2007 Kudo et al.
7,251,137 B2 * 7/2007 Iijima ..... F04D 13/0673 165/104.33
7,541,702 B2 6/2009 Murakami et al.
7,616,440 B2 * 11/2009 Franz ..... F04D 25/082 361/679.48
7,701,097 B2 * 4/2010 Lan ..... F04D 25/0613 310/60 A
7,872,381 B2 * 1/2011 Watanabe ..... F04D 19/007 310/58
7,878,772 B2 * 2/2011 Rexhauser ..... F04D 19/022 417/313
8,083,470 B2 * 12/2011 Yu ..... F04D 25/082 415/119
8,172,501 B2 * 5/2012 Nishizawa ..... F04D 29/522 415/214.1
8,324,766 B2 * 12/2012 Chen ..... F04D 25/082 310/58
8,899,930 B2 * 12/2014 Innocenti ..... B60K 11/02 415/143
9,022,754 B2 * 5/2015 Chou ..... F04D 25/0613 310/64
10,288,078 B2 * 5/2019 De Filippis ..... H02K 5/20
2004/0190250 A1 * 9/2004 Iijima ..... F04D 13/0673 361/697
2005/0280995 A1 * 12/2005 Iijima ..... F04D 13/0673 361/699
2006/0023425 A1 * 2/2006 Iijima ..... F04D 13/0673 361/699
2006/0119195 A1 * 6/2006 Liu ..... F04D 25/082 310/62
2006/0181163 A1 * 8/2006 Lee ..... H02K 9/06 310/62
2007/0152519 A1 * 7/2007 Jarrah ..... F04D 25/082 310/58
2007/0205676 A1 * 9/2007 Lan ..... F04D 25/0613 310/58
2008/0260530 A1 * 10/2008 Nishizawa ..... F04D 29/522 415/220
2009/0064946 A1 * 3/2009 Schultheiss ..... F01P 7/042 123/41.11
2009/0196744 A1 * 8/2009 Yu ..... F04D 25/0613 415/177
2010/0018826 A1 * 1/2010 Schultheiss ..... F04D 25/02 192/58.4
2010/0033041 A1 * 2/2010 Watanabe ..... F04D 19/007 310/63
2010/0163362 A1 * 7/2010 Sixt ..... F01P 5/06 192/58.4
2013/0028759 A1 * 1/2013 Berroth ..... F04D 25/0613 417/371
2013/0170967 A1 * 7/2013 Chou ..... F04D 25/0613 415/182.1
2015/0176602 A1 * 6/2015 Horng ..... F04D 29/5806 417/423.8
2016/0146210 A1 * 5/2016 De Filippis ..... F04D 29/329 416/93 R
2016/0186771 A1 * 6/2016 Evers ..... H02K 9/06 416/90 R

OTHER PUBLICATIONS

Taiwanese Office Action dated Oct. 3, 2019 for the corresponding Taiwanese Patent Application No. 105109484.

* cited by examiner

1

FAN DEVICE WITH IMPELLER HAVING CIRCULAR PLATE OPENING, SIDEWALL OPENING AND GROOVE CONNECTING THE CIRCULAR PLATE OPENING WITH THE SIDEWALL OPENING FOR EFFICIENTLY COOLING MOTOR

CROSS-REFERENCE TO RELATED APPLICATION

This application claims priority from Japanese Patent Application No. 2015-073858 filed with the Japan Patent Office on Mar. 31, 2015, the entire content of which is hereby incorporated by reference.

BACKGROUND

1. Technical Field

Embodiments of this disclosure relate to an impeller and a fan device that includes the impeller.

2. Description of the Related Art

Conventionally, a fan device using a motor may damage the motor and a circuit board for the motor and/or deteriorate the performance of the motor due to heat generated from the motor (a stator). In view of this, for the fan device using the motor, restraining the temperature rise of the motor by emitting the heat generated from the motor to the outside has been considered.

A fan device was disclosed in JP-A-2008-17607. This fan device has the center through-hole at the center of the impeller and also has the through-hole on the rotor cover. Furthermore, on the back side of the impeller, sub-vanes are provided for introducing outside air. With this fan device, during the rotation of the impeller, the outside air is introduced from the center through-hole by the sub-vanes. The introduced outside air flows through the through-hole on the rotor cover, and ensures cooling the motor.

SUMMARY

An impeller includes: a cylinder that includes a circular plate-shaped circular plate and a peripheral wall that extends from an outer peripheral edge of the circular plate along a rotation shaft of the impeller; and a blade mounted to an outer peripheral surface of the peripheral wall, the blade being configured to send air. The circular plate has a circular plate opening at a center, the circular plate opening penetrating the circular plate along the rotation shaft, and a sidewall opening is formed at the peripheral wall, the sidewall opening penetrating the peripheral wall along a direction different from a direction parallel to the rotation shaft.

DESCRIPTION OF THE EMBODIMENTS

Figure 1:
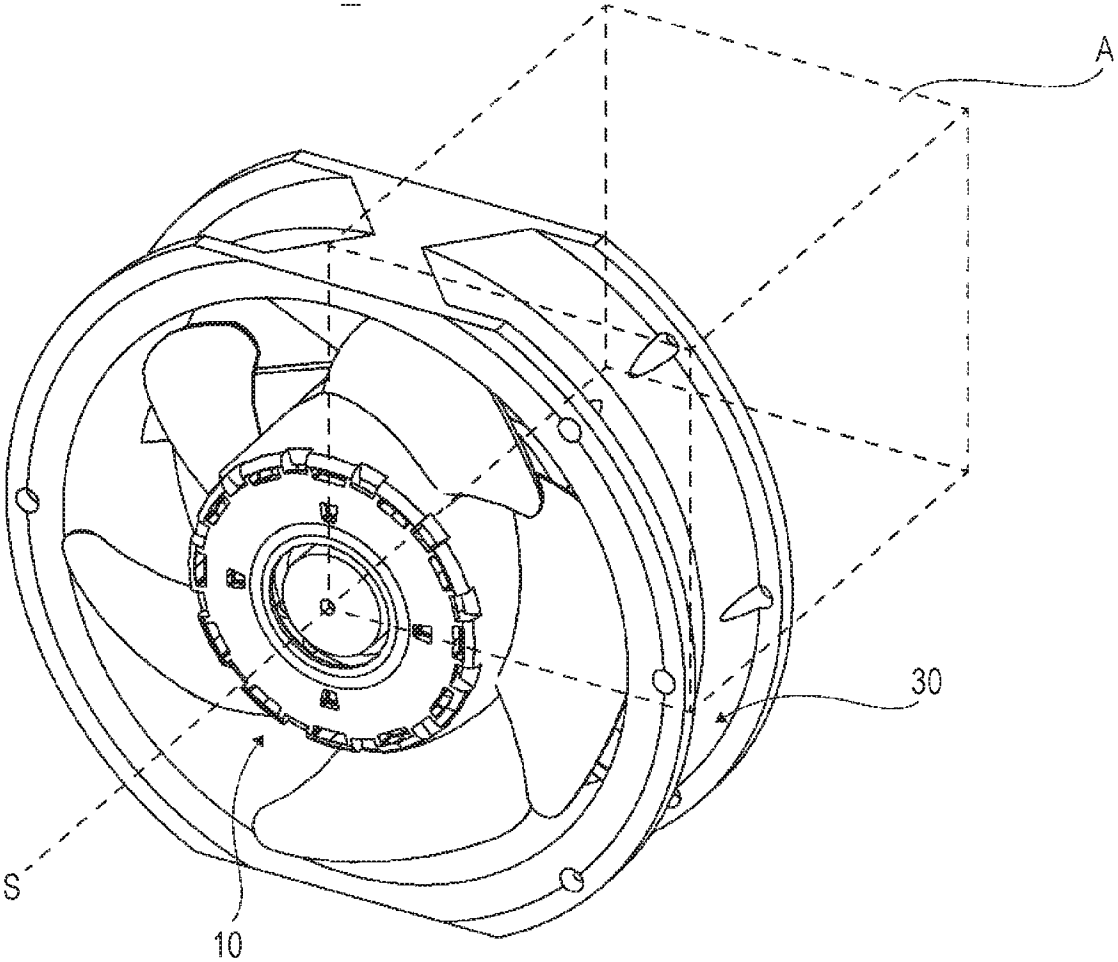
FIG. 1 is a perspective view illustrating an example of a fan device according to an embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

With a fan device, an airflow volume and static pressure have a relationship. Specifically, the fan device has airflow volume-static pressure characteristics in which the static pressure is decreased as the airflow volume becomes larger, and the static pressure is increased as the airflow volume becomes smaller.

However, as disclosed in JP-A-2008-17607, in the case where an impeller includes sub-vanes on the back side or the like, as compared with the case where the impeller does not include the sub-vanes on the back side or the like, the airflow volume-static pressure characteristics may be adversely affected.

Typically, the static pressure acts on the airflow volume from the actually used fan device. In view of this, the fan device has been requested to more efficiently cool the motor while the static pressure acts.

An object of this disclosure is to provide the following impeller and fan device. While restraining a negative effect given to the airflow volume-static pressure characteristics, these impeller and fan device can cool the motor more efficiently in the case where the static pressure acts (is present).

An impeller according to an aspect of this disclosure (the present impeller) includes: a cylinder that includes a circular plate-shaped circular plate and a peripheral wall that extends from an outer peripheral edge of the circular plate along a rotation shaft of the impeller; and a blade mounted to an outer peripheral surface of the peripheral wall, the blade being configured to send air. The circular plate has a circular plate opening at a center, the circular plate opening penetrating the circular plate along the rotation shaft, and a sidewall opening is formed at the peripheral wall, the sidewall opening penetrating the peripheral wall along a direction different from a direction parallel to the rotation shaft.

A fan device according to an aspect of this disclosure (the present fan device) includes the present impeller and a motor.

While restraining the negative effect given to the airflow volume-static pressure characteristics, these impeller and fan device can cool the motor used for the fan device more efficiently in the case where the static pressure acts.

The following describes an embodiment according to this disclosure.

First, an outline of a fan device 1 according to the embodiment is described with reference to FIGS. 1 and 2. FIG. 1 is a perspective view of the fan device 1, and FIG. 2 is an exploded perspective view of the fan device 1.

Figure 2:
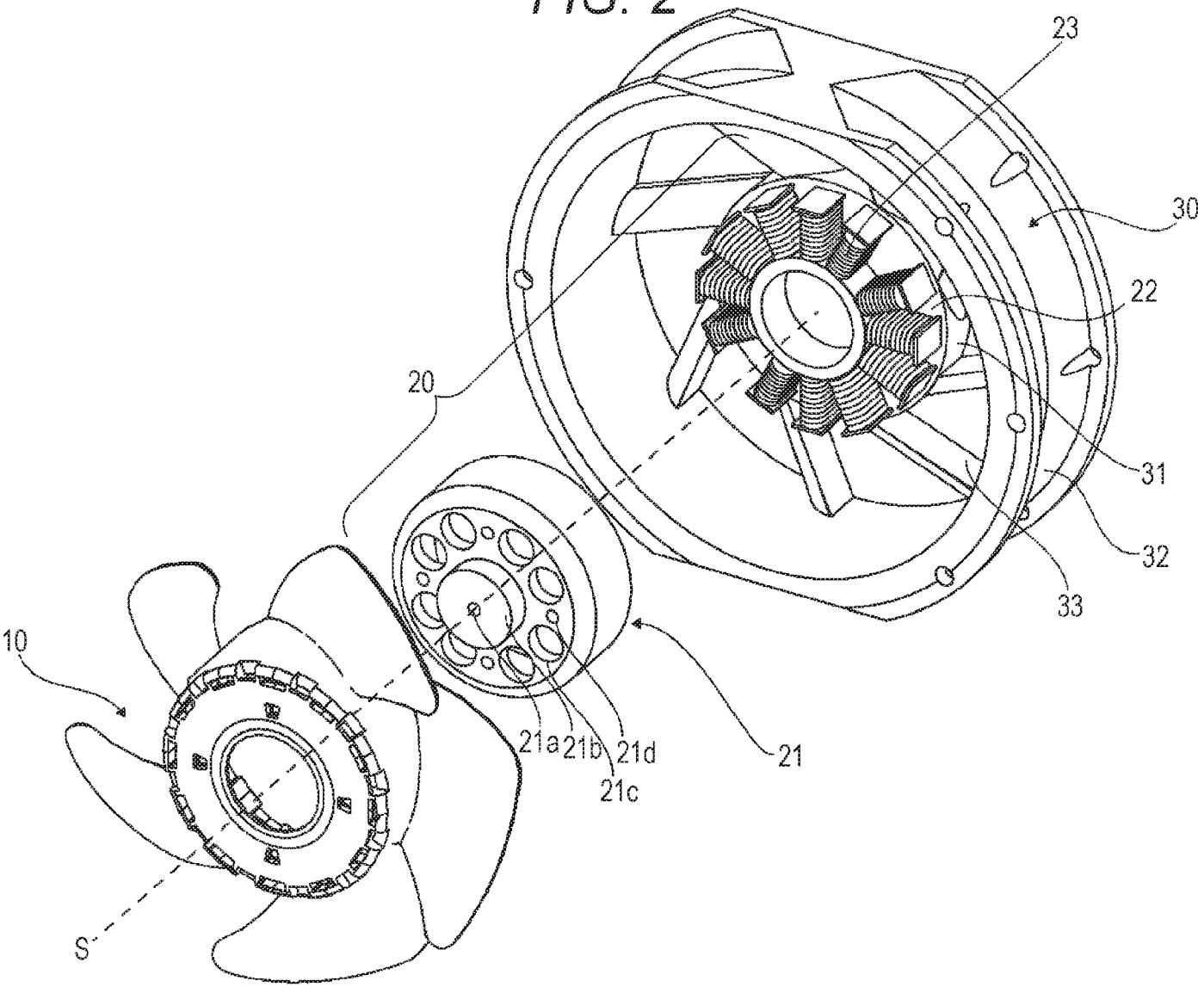
FIG. 2 is an exploded perspective view illustrating an example of the fan device.

As illustrated in FIGS. 1 and 2, the fan device 1 is a so-called axial fan. The fan device 1 at least includes a rotatable impeller 10, a motor 20, and a bracket 30 that surrounds the impeller 10 and the motor 20.

The motor 20 at least includes a rotor 21, a circuit board 22, which controls the motor 20 (excitation of coils), and a stator 23, which is mounted to the circuit board 22 and around which the coils are wound.

The rotor 21 has a cylindrical shape, is mounted to an inside of a cylinder 13, which will be described later, of the impeller 10, and includes a permanent magnet. The rotor 21 includes a shaft 21*a* (see FIG. 5) that serves as a rotation shaft of the impeller 10, a circular plate-shaped rotor circular plate 21*b*, eight rotor openings 21*c*, and four boss holes 21*d*. The rotor circular plate 21*b* is a member for mounting the shaft 21*a* to the rotor. The rotor openings 21*c* are disposed on a circular plate 11 (described later) side of the impeller 10 on the rotor 21. The rotor openings 21*c* penetrate the rotor 21 along the rotation shaft of the impeller 10. That is, the rotor openings 21*c* penetrate the rotor 21 (for example, a surface approximately vertical to a direction S, which is hereinafter referred to as a "rotation shaft direction S," of the rotor 21) along the rotation shaft direction S parallel to the rotation shaft of the impeller 10. Bosses 11*b* (see FIG. 4), which will be described later, are inserted into the boss holes 21*d*. On the inner peripheral surface side of the rotor 21, a permanent magnet 21*e* (see FIG. 5) is mounted.

The stator 23 is disposed inside the rotor 21.

In this embodiment, the number of the rotor openings 21*c* is eight, and the number of the boss holes 21*d* is four. The numbers of the rotor openings 21*c* and the boss holes 21*d* may be one or may be plural different from this embodiment. Furthermore, without distinction between the rotor openings 21*c* and the boss holes 21*d*, five or more (for example, 12) openings into which the four bosses 11*b* are insertable may be disposed.

The bracket 30 includes a column-shaped bracket base 31, a framing body 32, and a coupler 33. On the bracket base 31, the impeller 10, the rotor 21, and the circuit board 22 are placed. The framing body 32 forms the outer peripheral surface of the bracket 30. The coupler 33 couples the framing body 32 and the bracket base 31.

Figure 3:
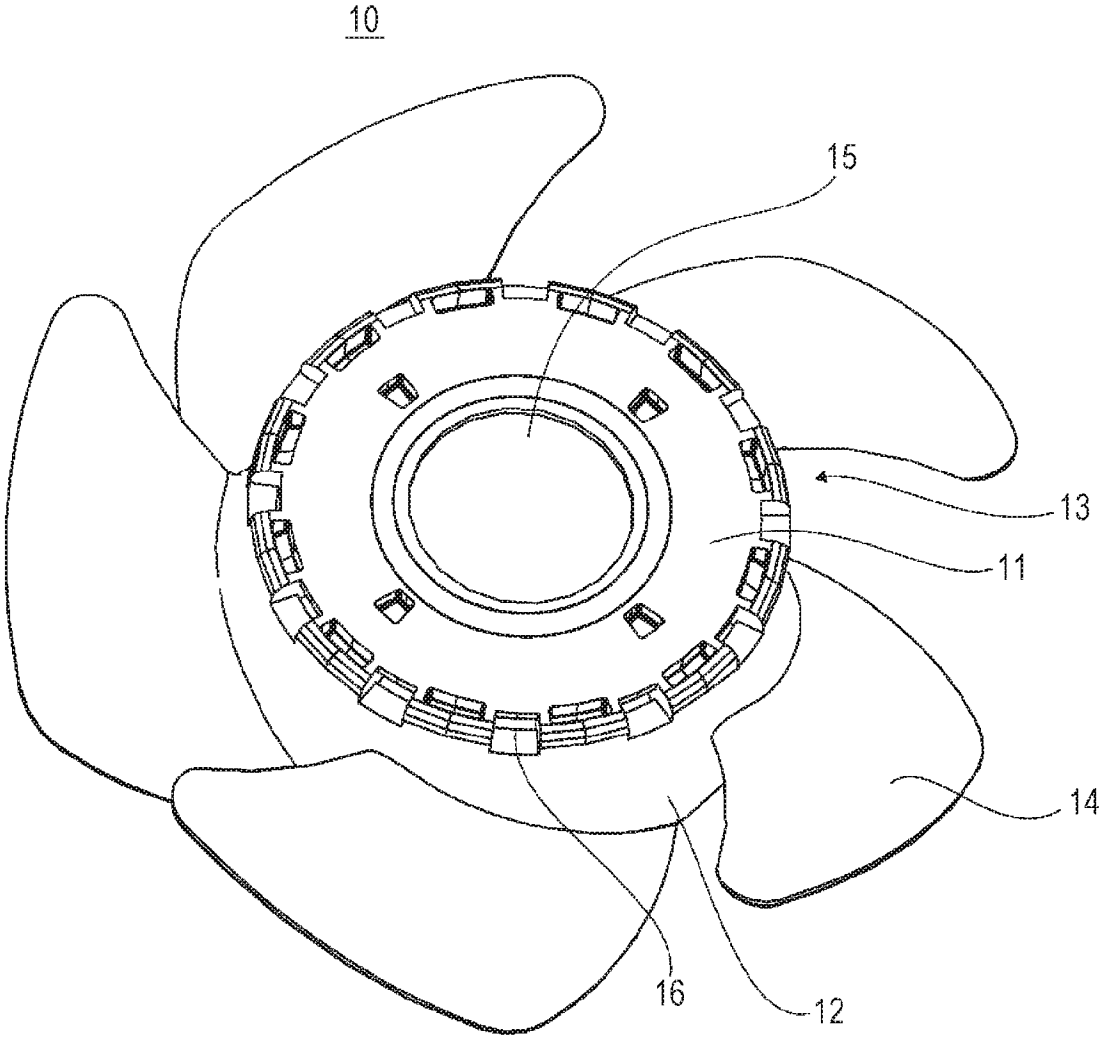
FIG. 3 is a perspective view illustrating an example of an impeller as viewed from a front side.
Figure 4:
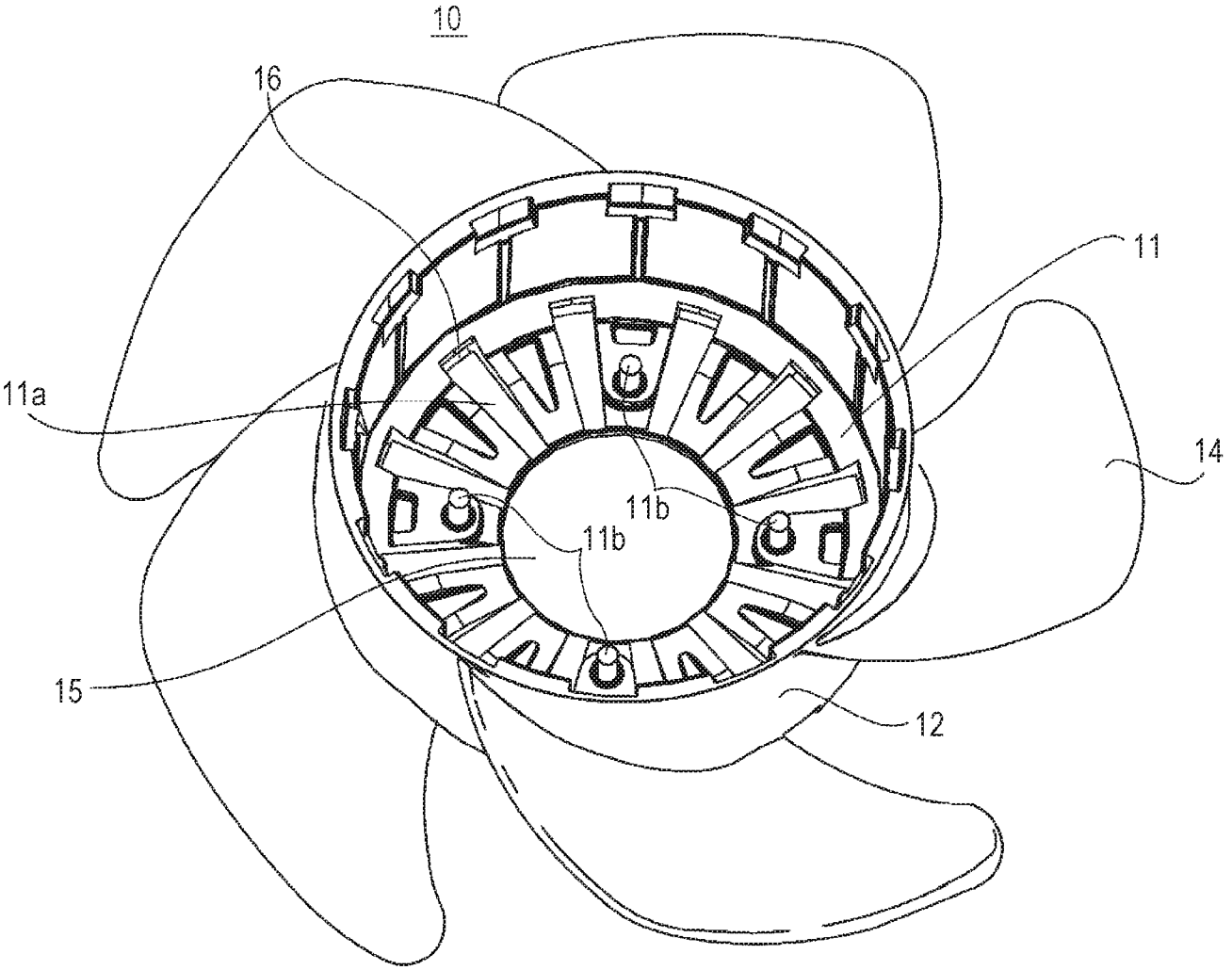
FIG. 4 is a perspective view illustrating an example of the impeller as viewed from a back side.

Next, the structure of the impeller 10 according to this embodiment is described with reference to FIGS. 3 and 4. FIG. 3 is a perspective view as viewing the impeller 10 from the front side, and FIG. 4 is a perspective view as viewing the impeller 10 from the back side.

As illustrated in FIG. 1, the impeller 10 is used for the fan device 1 with the motor 20. The impeller 10 includes the cylinder 13 and five blades 14. The cylinder 13 includes the circular plate-shaped circular plate 11 and a peripheral wall 12. The peripheral wall 12 extends from the outer peripheral edge (the end edge) of the circular plate 11 along the rotation shaft of the impeller 10. In other words, the peripheral wall 12 extends from the outer peripheral edge of the circular plate 11 along the rotation shaft direction S of the impeller 10. The blades 14 are mounted to the outer peripheral surface of the peripheral wall 12. The blades 14 are members for sending air.

On the approximately center of the circular plate 11, a circular plate opening 15 is formed. The circular plate opening 15 is a circular-shaped opening having a diameter larger than the diameter of the rotor circular plate 21*b*. The circular plate opening 15 penetrates the circular plate 11 along the rotation shaft of the impeller 10. In other words, the circular plate opening 15 penetrates the circular plate 11 (the cylinder 13) along the rotation shaft direction S of the impeller 10.

The peripheral wall 12 includes 12 sidewall openings 16. The sidewall openings 16 penetrate the peripheral wall 12 (the cylinder 13) vertically to the rotation shaft direction S of the impeller 10.

In this embodiment, the sidewall openings 16 are formed penetrating the peripheral wall 12 along the direction perpendicular to the rotation shaft direction S of the impeller 10. The penetrating direction of the sidewall opening 16 is not limited to this direction, and it is only necessary that the penetrating direction differs from the rotation shaft direction S of the impeller 10. That is, the sidewall opening 16 may penetrate the peripheral wall 12 along the direction different from the rotation shaft direction S. Additionally, the number of the sidewall openings 16 may be one or may be plural different from this embodiment.

As illustrated in FIG. 4, 12 inductors 11*a* and the four bosses 11*b* are formed on the back side (the back surface side) of the circular plate 11. The inductors 11*a* are grooves to induce air flowing through the circular plate opening 15 to the sidewall openings 16. The bosses 11*b* are inserted into boss holes 21*d* (see FIG. 2) of the rotor 21.

In this embodiment, the inductors 11*a* are grooves. Alternatively, as the inductors 11*a*, the right and left two walls may be disposed from the circular plate opening 15 to the sidewall openings 16.

Figure 5:
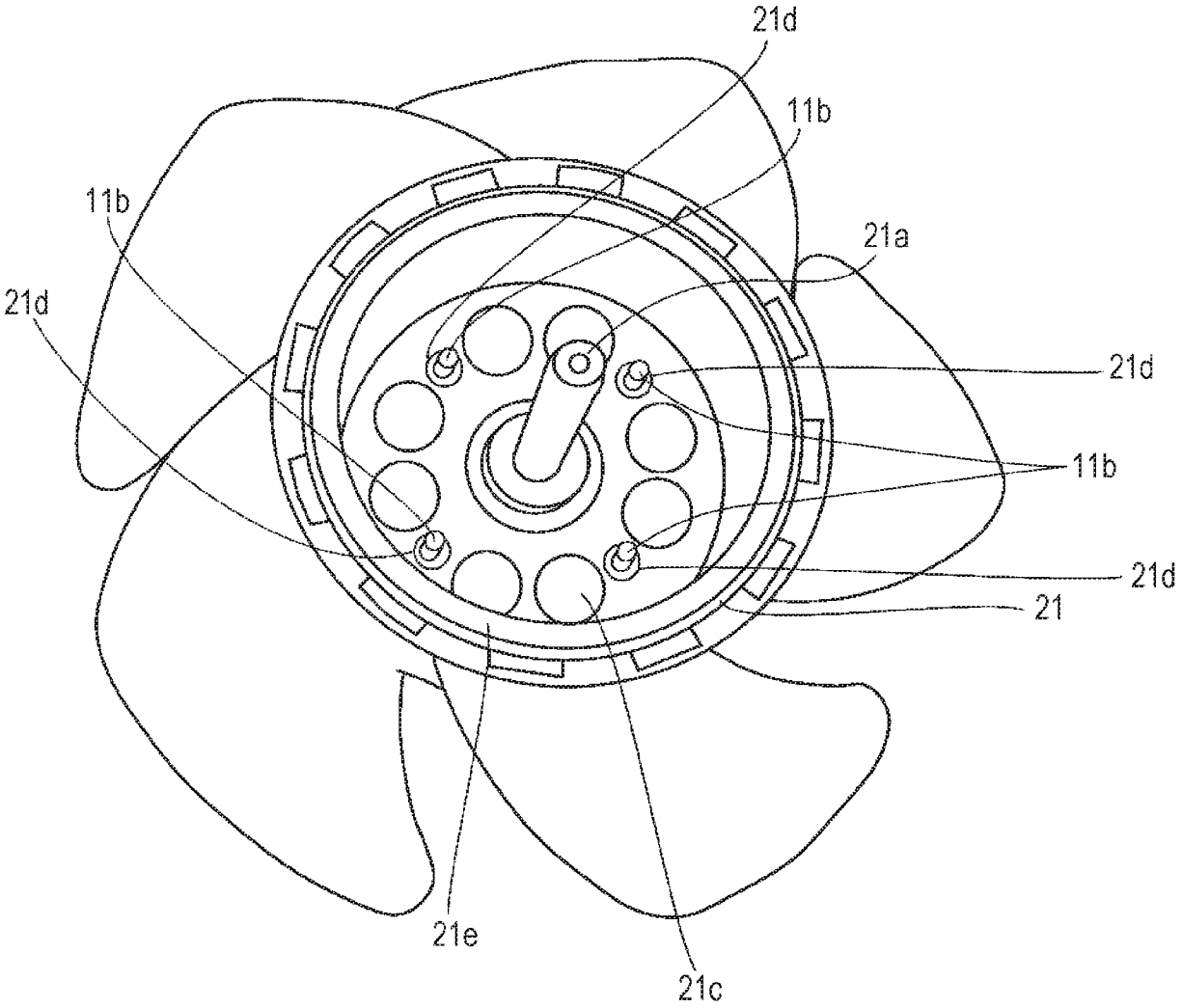
FIG. 5 is a perspective view illustrating an example of the impeller to which a rotor is mounted as viewed from the back side.

FIG. 5 is a perspective view illustrating the impeller 10 to which the rotor 21 is mounted as viewed from the back side.

As illustrated in FIG. 5, the boss holes 21*d* of the rotor 21 are inserted into the bosses 11*b*, which are formed on the back side of the circular plate 11, to secure the mounting position of the rotor 21 on the impeller 10. The rotor 21 is adhesively secured to the impeller 10. The rotation of the rotor 21 also rotates the impeller 10.

The eight rotor openings 21*c* on the rotor 21 allow the air to pass through. The rotor openings 21*c* are positioned facing the inductors 11*a*. In other words, when the rotor 21 is mounted to the impeller 10, the rotor 21 and the impeller 10 are constituted such that at least the one rotor opening 21*c* is disposed at a position facing the inductor 11*a* on the back side of the circular plate 11. The rotor 21 and the impeller 10 may be constituted such that all the rotor openings 21*c* are disposed at the positions facing the inductors 11*a*.

In this embodiment, while the number of rotor openings 21*c* is eight, the numbers of the inductors 11*a* and the sidewall openings 16 are 12. Alternatively, the numbers of the rotor openings 21*c*, the inductors 11*a*, and the sidewall openings 16 may be all the same.

Figure 6:
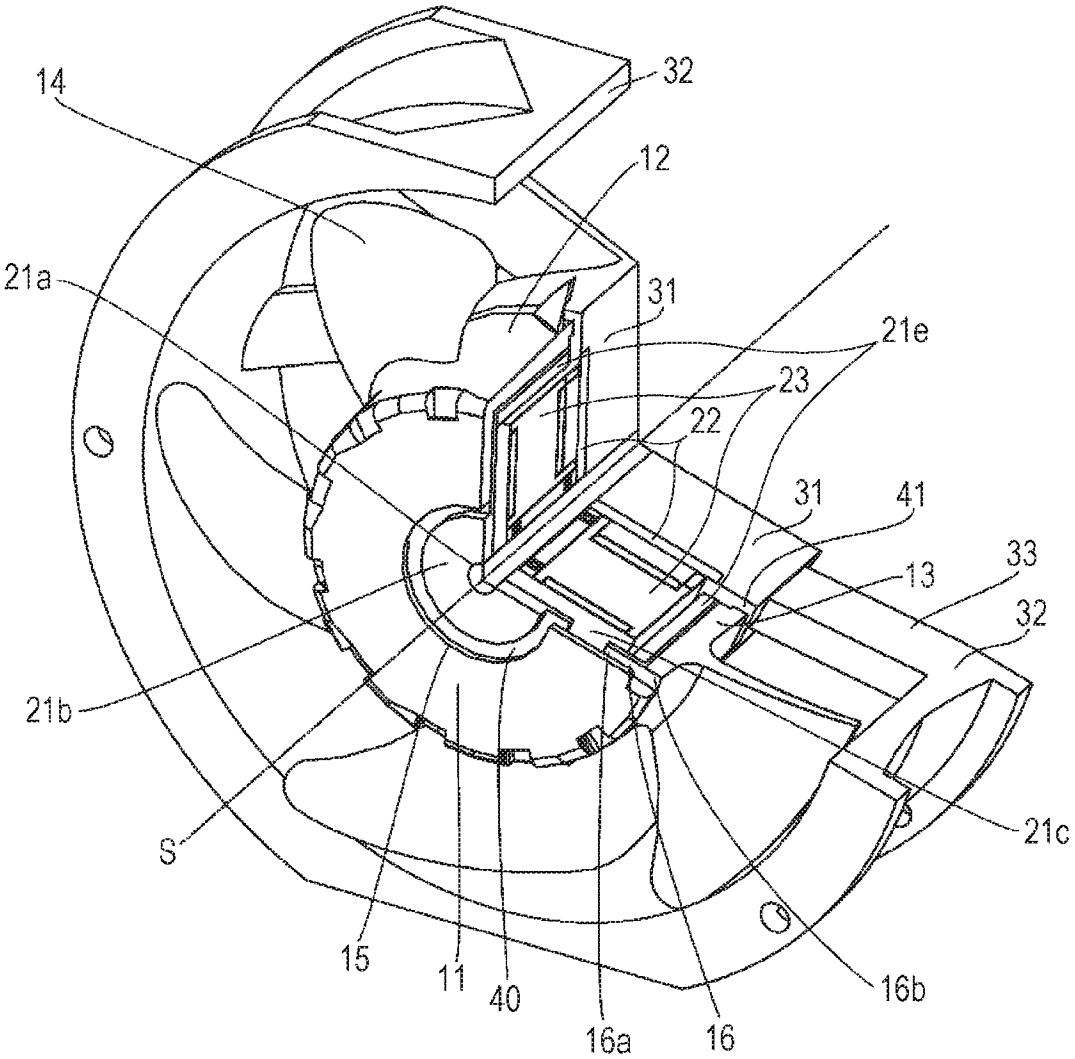
FIG. 6 is a cross-sectional explanatory view of the fan device from which a portion A in FIG. 1 is removed.

Next, the internal structure of the fan device 1 that includes the impeller 10 and the motor 20 is described with reference to FIG. 6. FIG. 6 is a cross-sectional explanatory view of the fan device 1 from which a portion A in FIG. 1 is removed.

As illustrated in FIG. 6, the diameter of the circular plate opening 15 is larger than the diameter of the rotor circular plate 21*b*. In view of this, the circular plate opening 15 forms a first windway 40 through which outside air is passable.

The sidewall opening 16 includes an intake port 16*a* and a discharging port 16*b*. The intake port 16*a* takes in the air inside the cylinder 13. That is, the intake port 16*a* takes in the air from the first windway 40 or the air from the motor 20. The discharging port 16*b* discharges the air taken from the intake port 16*a* to the outside of the cylinder 13.

Here, the discharging port 16*b* is formed on the circular plate 11 side with respect to an installation surface of the peripheral wall 12 to which the blades 14 are mounted. Thus, the air discharged from the discharging port 16*b* is sent by the blades 14.

Between the cylinder 13 and the bracket base 31, a second windway 41 through which the outside air is passable is formed.

In view of this, the fan device 1 is constituted such that the air flows to the motor 20 via the first windway 40, the second windway 41, and the rotor openings 21*c*. Accordingly, the motor 20 can be cooled down.

Figure 7A:
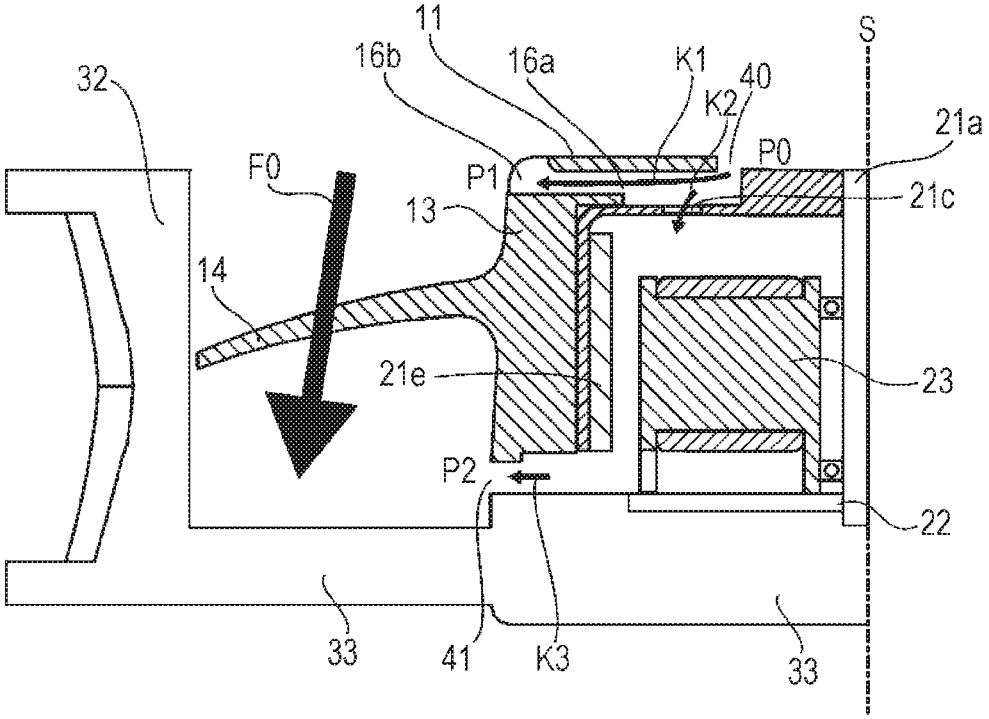
FIGS. 7A and B are explanatory views illustrating examples to describe airflow in the fan device.
Figure 7B:
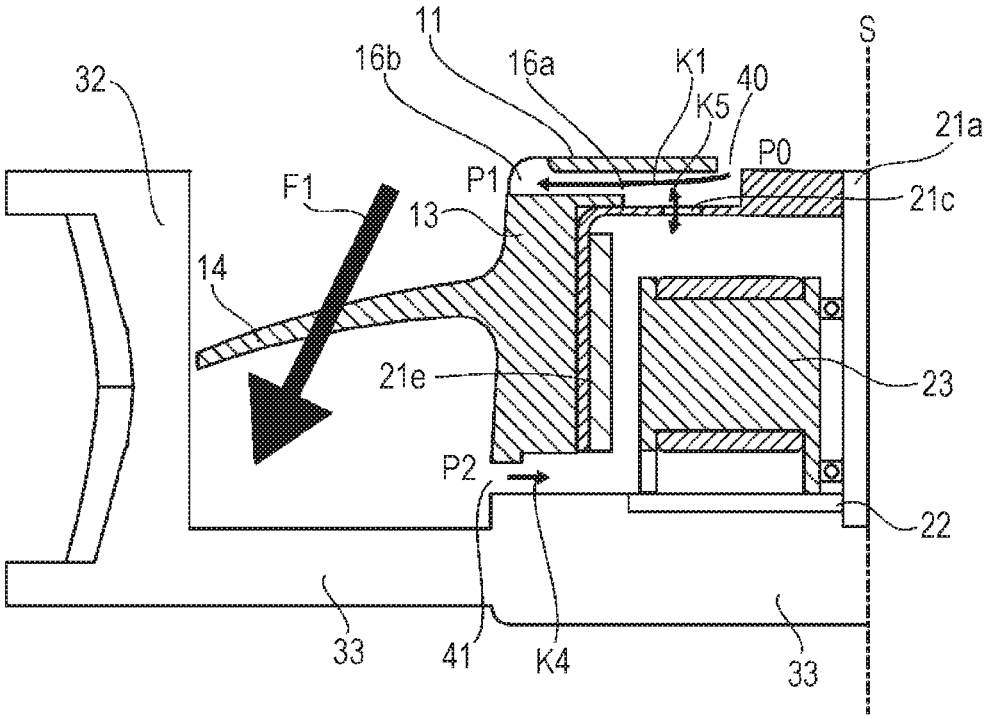

Next, the airflow in the fan device 1 according to this embodiment is described with reference to FIGS. 7A and 7B. FIGS. 7A and 7B are explanatory views to describe the airflow in the fan device 1, and are cross-sectional views corresponding to FIG. 6. FIG. 7A is an explanatory view to describe the airflow in the fan device 1 when the static pressure does not act (the static pressure is approximately zero, during a so-called free air). FIG. 7B is an explanatory view to describe the airflow in the fan device 1 when the static pressure acts.

As illustrated in FIG. 7A, when the static pressure does not act, the blades 14 cause the air to flow along an inclined direction F0, which is slightly inclined to the outside of the blades 14 almost approximately parallel to the rotation shaft direction S of the impeller 10. The magnitude of the inclination of the inclined direction F0 (for example, the inclination to the rotation shaft direction S) changes depending on the shape of the blades 14 and the like.

This high-speed flow of the air by the blades 14 along the inclined direction F0 lowers a pressure P1 near the discharging port 16*b*, as compared with a pressure P0 near the first windway 40. Accordingly, as indicated by an arrow K1, the air flows from the first windway 40 to the discharging port 16*b*.

A pressure P2 near the second windway 41 has a value approximately identical to the pressure P1 near the discharging port 16*b*. In view of this, the pressure P2 is lower than the pressure P0 near the first windway 40. Therefore, as indicated by an arrow K2, the air taken from the first windway 40 flows to the motor 20 via the rotor openings 21*c*. Furthermore, as indicated by an arrow K3, the air inside the motor 20 flows to the second windway 41.

As illustrated in FIG. 7B, while the static pressure acts, the blades 14 cause the air to flow along an inclined direction F1, which is largely inclined to the outside of the blades 14 with respect to the rotation shaft direction S of the impeller 10. The magnitude of the inclination of the inclined direction F1 (for example, the inclination with respect to the rotation shaft direction S) changes depending on the shape of the blades 14, the magnitude of the static pressure, and the like.

Similarly to FIG. 7A, the pressure P1 near the discharging port 16*b* is lower than the pressure P0 near the first windway 40. In view of this, as indicated by the arrow K1, the air taken from the first windway 40 flows to the discharging port 16*b*.

Unlike FIG. 7A, the flow rate of air by the blades 14 near the second windway 41 is slower than the flow rate of air by the blades 14 near the discharging port 16*b*. Accordingly, the pressure P2 near the second windway 41 is higher than the pressure P1 near the discharging port 16*b*. In view of this, as indicated by an arrow K4, the air flows from the second windway 41 to the discharging port 16*b*.

The pressure P2 near the second windway 41 is lower than the pressure P0 near the first windway 40. According to a pressure difference between the pressure P1 near the discharging port 16*b* and the pressure P2 near the second windway 41, and a pressure difference between the pressure P1 near the discharging port 16*b* and the pressure P0 near the first windway 40, as indicated by an arrow K5, the air inside the motor 20 flows to the discharging port 16*b* and the air taken from the first windway 40 flows to the rotor openings 21*c*.

The above-described fan device 1 according to this embodiment and the typical fan device are hereinafter compared to each other.

Figure 8:
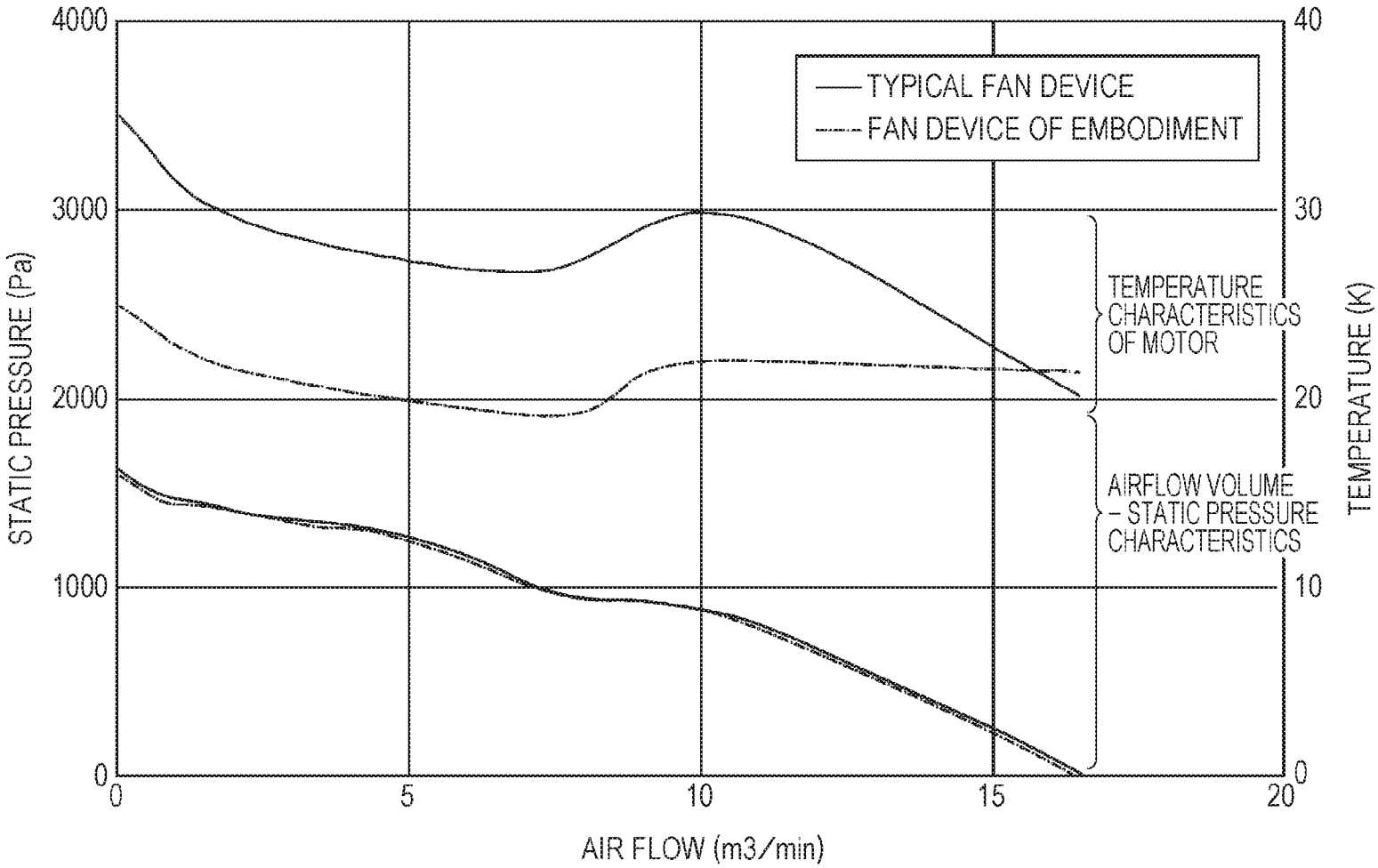
FIG. 8 is a diagram for describing relationships between airflow volume-static pressure characteristics and a temperature of a motor in the fan device according to the embodiment of this disclosure and a typical fan device.

FIG. 8 illustrates relationships between the airflow volume-static pressure characteristics and the temperature characteristics of the motor in the fan device 1 according to the embodiment and the typical fan device. In FIG. 8, the left vertical axis indicates the static pressure (Static Pressure), the lower horizontal axis indicates the airflow volume (Air Flow), and the right vertical axis indicates the temperature (temperature) of the motor (a winding wire wound around the stator). The solid lines indicate the properties of the typical fan device while the one dot chain lines indicate the properties of the fan device 1 according to the embodiment. The upper solid line indicates the temperature characteristics of the motor in the typical fan device. The upper one dot chain line indicates the temperature characteristics of the motor in the fan device 1. The lower solid line indicates the airflow volume-static pressure characteristics in the typical fan device. The lower one dot chain line indicates the airflow volume-static pressure characteristics in the fan device 1.

Here, the typical fan device is a fan device that does not include the sidewall openings 16. In the measurements related to FIG. 8, as the typical fan device, the fan device 1 whose sidewall openings 16 are experimentally obstructed is used (see FIG. 3 and the like).

The temperature characteristics of the motor, which are shown on the upper side in FIG. 8, are the temperature characteristics of the motor when the static pressure acts (the static pressure: within the range of about 100 to about 1600, the airflow volume: within the range of 0 to about 16). As illustrated in this drawing, it has been found that the fan device 1 according to this embodiment was able to cool the motor low up to 8 K, as compared with the typical fan device.

According to the airflow volume-static pressure characteristics on the lower side in FIG. 8, the shapes of the airflow volume-static pressure characteristics mostly match between the fan device 1 according to this embodiment and the typical fan device. In view of this, it has been found that, with the fan device 1 of this embodiment, the sidewall openings 16 do not adversely affect the airflow volume-static pressure characteristics as compared with the typical fan device.

As described above, while the fan device 1 according to this embodiment restrains adversely affecting the airflow volume-static pressure characteristics, the fan device 1 ensures cooling the motor used for the fan device more efficiently when the static pressure acts.

In this embodiment, the inductors 11*a* are formed on the back side of the circular plate 11. Alternatively, the impeller 10 and the fan device 1 of this embodiment may not include the inductors 11*a*.

In this embodiment, the fan device 1 includes at least the one rotor opening 21*c* disposed at the position facing the inductor 11*a*. Alternatively, the fan device 1 may be constituted such that the all rotor openings 21*c* are disposed at positions not facing the inductors 11*a*.

In this embodiment, the fan device 1 is an axial fan that includes one impeller. Alternatively, the fan device 1 may be a multiplexed (duplex) inverting axial fan where a plurality of (two) impellers are directly disposed. In this case, among the plurality of impellers, at least one impeller may be the impeller 10 according to this embodiment.

The embodiment of this disclosure may be any of the following first to third impellers and first to third fan devices.

The first impeller is an impeller used for a fan device with a motor. The impeller includes a cylinder and a blade. The cylinder forms a circular plate-shaped circular plate and a peripheral wall. The peripheral wall extends from an outer peripheral edge of the circular plate parallel to a rotation shaft of the impeller. The blade is mounted to an outer peripheral surface of the peripheral wall. The blade is configured to send air. The circular plate forms a circular plate opening at a center. The circular plate opening penetrates parallel to the rotation shaft. At the peripheral wall, a sidewall opening is formed. The sidewall opening penetrates in a direction different from the direction parallel to the rotation shaft.

The second impeller according to the first impeller is configured as follows. The circular plate forms an inductor on a back surface side. The inductor is configured to induce air flowing through the circular plate opening to the sidewall opening.

The third impeller according to the first or the second impeller is configured as follows. The sidewall opening forms an intake port and a discharging port on the peripheral wall. The intake port is configured to take in air inside the cylinder. The discharging port is configured to discharge the air taken from the intake port to outside of the cylinder. The discharging port is formed on the circular plate side with respect to an installation surface of the peripheral wall to which the blade is mounted.

The first fan device is a fan device with an impeller and a motor. The impeller includes a cylinder and a blade. The cylinder includes a circular plate-shaped circular plate and has a peripheral wall. The peripheral wall extends from an end edge of the circular plate parallel to a rotation shaft of an impeller. The blade is mounted to an outer peripheral surface of the peripheral wall. The blade is configured to send air. The circular plate has a circular plate opening at a center. The circular plate opening penetrates parallel to the rotation shaft. At the peripheral wall, a sidewall opening is formed. The sidewall opening penetrates in a direction different from the direction parallel to the rotation shaft.

The second fan device according to the first fan device is configured as follows. The motor at least includes a cylindrical-shaped rotor and a stator. The rotor is mounted to an inside of the cylinder on the impeller. The rotor includes a permanent magnet. The stator is disposed inside the rotor. The rotor opening is formed on the circular plate side of the rotor. The rotor opening penetrates parallel to the rotation shaft.

The third fan device according to the second fan device is configured as follows. The impeller forms an inductor on a back surface side of the circular plate. The inductor is configured to induce air flowing through the circular plate opening to the sidewall opening. The rotor opening of the motor is disposed at a position facing the inductor when the rotor is mounted to an inside of the impeller.

According to the first to the third impellers and the first to the third fan devices, the motor used for the fan device can be more efficiently cooled without giving a negative effect to the airflow volume-static pressure characteristics in the case where the static pressure acts.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A fan device comprising an impeller and a motor, the impeller comprising: a cylinder that includes a circular plate and a peripheral wall that extends from an outer peripheral edge of the circular plate along a rotation shaft of the impeller; and a blade mounted to an outer peripheral surface of the peripheral wall, the blade being configured to send air, wherein the circular plate has a circular plate opening at a center, the circular plate opening overlapping the rotation shaft of a rotor in a direction of the rotation shaft and penetrating the circular plate along the rotation shaft, a sidewall opening is formed at the peripheral wall, the sidewall opening penetrating the peripheral wall along a direction different from a direction of the rotation shaft, the circular plate comprises a groove formed on a back surface side of the circular plate, the groove configured to induce air flowing from the circular plate opening to the sidewall opening, the groove connects the circular plate opening with the sidewall opening, the motor at least includes: the rotor being cylindrically shaped and mounted to an inside of the cylinder of the impeller, the rotor including a permanent magnet; and a stator disposed inside the rotor, and a rotor opening is formed on a side close to the circular plate of the impeller, the rotor opening penetrating the rotor along the rotation shaft: wherein the sidewall opening includes an intake port and a discharging port, the intake port being configured to take in air inside the cylinder of the motor through the rotor opening, the discharging port being configured to discharge the air taken from the intake port to outside of the cylinder of the impeller, and the discharging port is formed on a side close to the circular olate with respect to an installation surface of the peripheral wall to which the blade is mounted.

2. The fan device according to claim 1, wherein the rotor opening on the rotor of the motor is disposed at a position facing the groove.

3. The fan device according to claim 1, wherein the rotor includes a rotor circular plate for mounting the rotation shaft to the rotor, and a diameter of the circular plate opening of the impeller is larger than a diameter of the rotor circular plate.

4. The fan device according to claim 1, wherein the sidewall opening includes an intake port and a discharging port, the intake port being configured to take in air inside the cylinder of the motor through the rotor opening, the discharging port being configured to discharge the air taken form the intake port to outside of the cylinder of the impeller, and the intake port is different from the circular plate opening and configured to also take in air passed through the circular plate opening.

5. A fan device comprising an impeller and a motor, the impeller comprising: a cylinder that includes a circular plate and a peripheral wall that extends from an outer peripheral edge of the circular plate along a rotation shaft of the impeller; and a blade mounted to an outer peripheral surface of the peripheral wall, the blade being configured to send air; wherein the circular plate has a circular plate opening at a center, the circular plate opening overlapping the rotation shaft of a rotor in a direction of the rotation shaft and penetrating the circular plate along the rotation shaft, a sidewall opening is formed at the peripheral wall, the sidewall opening penetrating the peripheral wall along a direction different from a direction of the rotation shaft, the circular plate comprises a groove formed on a back surface side of the circular plate, the groove configured to induce air flowing from the circular plate opening to the sidewall opening, the groove connects the circular plate opening with the sidewall opening, the sidewall opening includes an intake port and a discharging port, the intake port being configured to take in air inside the cylinder of the motor through a rotor opening, the discharging port being configured to discharge the air taken from the intake port to outside of the cylinder of the impeller, the discharging port is formed on a side close to the circular plate with respect to an installation surface of the peripheral wall to which the blade is mounted, the peripheral wall comprises a first part, a second part and an intermediate part between the first part and the second part in the direction of the rotation shaft, the first part being connected with the circular plate, the second part being directly connected with the blade, the intermediate part being a part on which the discharging port is formed, the motor at least includes: the rotor being cylindrically shaped and mounted to an inside of the cylinder of the impeller, the rotor including a permanent magnet; and a stator disposed inside the rotor, and the rotor opening is formed on a side close to the circular plate of the impeller, the rotor opening penetrating the rotor along the rotation shaft.

* * * * *